US008499362B2

(12) United States Patent
Dennis

(10) Patent No.: US 8,499,362 B2
(45) **Date of Patent: *Aug. 6, 2013**

(54) ARMOR VEST WITH MECHANICAL QUICK RELEASE MECHANISM

(75) Inventor: David Dennis, St. Helens, OR (US)

(73) Assignee: Guardian Protective Technologies Inc., Walnut Creek, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/468,973

(22) Filed: May 10, 2012

(65) Prior Publication Data

US 2012/0304355 A1 Dec. 6, 2012

Related U.S. Application Data

(63) Continuation of application No. 12/948,690, filed on Nov. 17, 2010, now Pat. No. 8,201,271.

(60) Provisional application No. 61/262,875, filed on Nov. 19, 2009.

(51) Int. Cl.
*A41D 1/04* (2006.01)
*A41F 19/00* (2006.01)

(52) U.S. Cl.
USPC ..... 2/102; 2/92; 2/96; 2/100; 2/265; 2/310

(58) Field of Classification Search
USPC ..... 2/2.5, 92, 102, 310–342, 265
See application file for complete search history.

(56) References Cited

U.S. PATENT DOCUMENTS

| | | | | |
|---|---|---|---|---|
| 2,542,248 | A * | 2/1951 | Heffernan et al. | 244/122 B |
| 2,807,035 | A * | 9/1957 | Phillips | 441/115 |
| 2,989,274 | A * | 6/1961 | Moran | 144/151 |
| 3,436,777 | A * | 4/1969 | Greenwood | 405/186 |
| 3,834,758 | A * | 9/1974 | Soule | 297/484 |
| 3,936,092 | A * | 2/1976 | Dietz | 297/465 |
| 4,042,194 | A * | 8/1977 | Frost et al. | 244/151 A |
| 4,106,121 | A * | 8/1978 | Belson | 2/102 |
| 4,263,686 | A | 4/1981 | Jarvis | |
| 4,276,670 | A * | 7/1981 | Marchello et al. | 441/115 |
| 4,501,027 | A * | 2/1985 | Olsson | 2/321 |

(Continued)

FOREIGN PATENT DOCUMENTS

WO WO 2008/108856 A2 9/2008

OTHER PUBLICATIONS

Takata, "Takata Racing Products," located at http://takataracingproducts.com, accessed on Nov. 9, 2010, p. 1.

(Continued)

*Primary Examiner* — Bobby Muromoto, Jr.
(74) *Attorney, Agent, or Firm* — Leydig, Voit & Mayer, LLP; Gerald T. Gray

(57) ABSTRACT

Bulletproof vests, body armor, and other tactical vests with quick release buckle mechanisms are described along with methods of their use. The multi-point buckle mechanisms release upon rotating a shaft, allowing the vest panels and straps to fall cleanly to the ground without knocking the wearer off balance. Waist belt clips allow a wearer to put the vest on over his or her head without engaging the emergency release, or the multi-point buckle mechanism can release only the waist straps upon rotating the shaft in the opposite direction. A flap protects the rotatable quick release mechanism from inadvertent activation.

20 Claims, 10 Drawing Sheets

(56) References Cited

U.S. PATENT DOCUMENTS

| | | | | |
|---|---|---|---|---|
| 4,545,773 | A * | 10/1985 | Evert | 441/114 |
| 4,553,633 | A * | 11/1985 | Armstrong et al. | 182/3 |
| 4,567,809 | A * | 2/1986 | Van Sloun | 89/1.55 |
| 4,656,700 | A | 4/1987 | Tanaka et al. | |
| 4,973,277 | A * | 11/1990 | Khanamirian | 441/88 |
| 5,060,314 | A * | 10/1991 | Lewis | 2/2.5 |
| 5,072,458 | A | 12/1991 | Suzuki | |
| 5,074,588 | A * | 12/1991 | Huspen | 280/801.1 |
| 5,074,714 | A * | 12/1991 | Franco | 405/186 |
| 5,148,582 | A * | 9/1992 | Dennis, Jr. | 24/625 |
| 5,410,780 | A * | 5/1995 | Silagy | 24/168 |
| 5,681,094 | A * | 10/1997 | Brown et al. | 297/484 |
| 5,978,961 | A * | 11/1999 | Barker | 2/2.5 |
| 5,988,098 | A * | 11/1999 | Hillhouse | 114/347 |
| 5,991,925 | A * | 11/1999 | Wu | 2/102 |
| 6,185,738 | B1 | 2/2001 | Sidebottom | |
| 6,431,424 | B1 * | 8/2002 | Smith | 224/583 |
| 6,478,510 | B1 | 11/2002 | Young | |
| 6,637,083 | B1 * | 10/2003 | Howell | 24/614 |
| 6,675,391 | B2 | 1/2004 | Morrison | |
| 6,763,557 | B2 * | 7/2004 | Steiff et al. | 24/639 |
| 6,800,007 | B2 | 10/2004 | Calkin | |
| 6,808,046 | B1 * | 10/2004 | Henson | 182/3 |
| 6,820,721 | B1 * | 11/2004 | Henson | 182/5 |
| 6,824,106 | B2 * | 11/2004 | Douglas et al. | 244/151 R |
| 7,020,897 | B2 * | 4/2006 | Johnson | 2/102 |
| 7,047,570 | B2 * | 5/2006 | Johnson | 2/102 |
| 7,073,234 | B2 * | 7/2006 | Turpin | 24/579.09 |
| 7,210,707 | B2 * | 5/2007 | Schroth | 280/801.1 |
| 7,243,376 | B2 * | 7/2007 | Johnson | 2/102 |
| 7,424,748 | B1 * | 9/2008 | McDunn et al. | 2/2.5 |
| 7,490,361 | B1 | 2/2009 | Floyd | |
| 7,520,036 | B1 | 4/2009 | Baldwin et al. | |
| 7,625,048 | B2 | 12/2009 | Rouhana et al. | |
| 7,694,862 | B2 * | 4/2010 | Bergeron | 224/665 |
| 8,201,271 | B2 * | 6/2012 | Dennis | 2/102 |
| 2003/0033697 | A1 * | 2/2003 | Hicks et al. | 24/615 |
| 2004/0000038 | A1 * | 1/2004 | Steiff et al. | 24/164 |
| 2005/0073187 | A1 * | 4/2005 | Frank et al. | 297/484 |
| 2005/0082815 | A1 * | 4/2005 | Frank et al. | 280/801.1 |
| 2005/0179244 | A1 * | 8/2005 | Schroth | 280/808 |
| 2005/0250582 | A1 * | 11/2005 | Lopez | 463/47 |
| 2005/0269160 | A1 * | 12/2005 | Flux | 182/234 |
| 2006/0011677 | A1 * | 1/2006 | Burnsed et al. | 224/150 |
| 2006/0070215 | A1 * | 4/2006 | Sung | 24/615 |
| 2006/0255647 | A1 * | 11/2006 | Hyatt et al. | 297/481 |
| 2007/0039085 | A1 | 2/2007 | Kovacevich et al. | |
| 2008/0153370 | A1 * | 6/2008 | Wagner | 441/115 |
| 2008/0171501 | A1 * | 7/2008 | Woods et al. | 451/451 |
| 2008/0235841 | A1 * | 10/2008 | McDunn et al. | 2/2.5 |
| 2008/0257929 | A1 * | 10/2008 | Cragg | 224/649 |
| 2008/0263737 | A1 * | 10/2008 | Parks et al. | 2/2.5 |
| 2009/0025126 | A1 * | 1/2009 | Crossman et al. | 2/456 |
| 2009/0095232 | A1 * | 4/2009 | McKay | 119/770 |
| 2009/0200106 | A1 * | 8/2009 | McKay et al. | 182/3 |
| 2009/0211000 | A1 * | 8/2009 | Roux | 2/462 |
| 2009/0282595 | A1 * | 11/2009 | Branson et al. | 2/2.5 |
| 2010/0025560 | A1 * | 2/2010 | Beck | 248/558 |
| 2010/0043112 | A1 * | 2/2010 | Khandelwal | 2/2.5 |
| 2010/0071106 | A1 * | 3/2010 | Parks et al. | 2/2.5 |
| 2010/0089955 | A1 * | 4/2010 | Watson | 224/259 |
| 2010/0229357 | A1 * | 9/2010 | Sample et al. | 24/601.5 |
| 2010/0235957 | A1 * | 9/2010 | Dovner et al. | 2/2.5 |
| 2010/0244424 | A1 * | 9/2010 | Kranz et al. | 280/808 |
| 2010/0313329 | A1 * | 12/2010 | Haynes | 2/102 |
| 2010/0313392 | A1 * | 12/2010 | Anscher | 24/616 |
| 2011/0023203 | A1 * | 2/2011 | Dovner et al. | 2/2.5 |
| 2011/0072546 | A1 * | 3/2011 | Taylor et al. | 2/2.5 |
| 2011/0072565 | A1 | 3/2011 | Krueger et al. | |
| 2011/0072566 | A1 * | 3/2011 | Kovacevich et al. | 2/463 |
| 2011/0094006 | A1 * | 4/2011 | Cole et al. | 2/102 |
| 2011/0099776 | A1 * | 5/2011 | Anscher | 24/629 |

OTHER PUBLICATIONS

ILB—ILOVEBODYKITS.COM, "NRG Universal 5 Point/Cam Lock 3" Safety Harness Black," located at http://www.ilovebodykits.com/product/26773/NRG_Universal_5_Point_Cam_Lock_3_. . . , accessed on Nov. 9, 2010, 2 pages.

SBH-6PCB, "Photo gallery for SBH-6PCB 6 Point 3 Inch Cam Lock Seat Belt Harness-Black | NRG I . . . ," located at http://www.getnrg.com/node/385/image_gallery, accessed on Nov. 9, 2010, 1 page.

NRG Innovations, "Amazon.com: NRG nnovations SBH-6PCBL Cam Lock Seat Belt Harnesses: Automotiv . . . ," located at http://www.amazon.com/dp/B0014U5XUM/ref=asc_df_B0014U5XUM1295033?smid=A . . . , accessed on Nov. 9, 2010, pp. 1-2.

International Search Report and Written Opinion mailed on Jul. 28, 2011, for International Application No. PCT/US2010/057294 filed Nov. 18, 2010, 10 pages.

* cited by examiner

ARMOR VEST WITH MECHANICAL QUICK RELEASE MECHANISM

CROSS-REFERENCES TO RELATED APPLICATIONS

This application claims the benefit of U.S. Provisional Application No. 61/262,875, filed Nov. 19, 2009, which is hereby incorporated by reference in its entirety for all purposes.

STATEMENT AS TO RIGHTS TO INVENTIONS MADE UNDER FEDERALLY SPONSORED RESEARCH OR DEVELOPMENT

Not Applicable

BACKGROUND

1. Field of the Art

The present application relates generally to tactical vests, and more particularly to release mechanisms for body armor and bulletproof vests.

2. Discussion of the Related Art

Bulletproof vests, body armor, flak jackets, and other ballistic resistant garments have become commonplace equipment in law enforcement and in many advanced militaries of the world. Such garments prevent small arms fire from piercing through and harming the wearer. A wearer in an armed conflict has a tactical advantage over those who do not wear such garments because the wearer is shielded from the effects of many types of common weapons.

Ballistic resistant vests are typically made of a woven fabric shell and have layers of anti-ballistic materials such as Du Pont, Inc.'s Kevlar® material, armor panels, and stab-resistant materials. Nylon webbing and other fabrics comprise much of the rest of the vests.

Many ballistic resistant garments typically envelop the torso so as to protect vital body organs. Because such ballistic resistant garments often do not cover the arms, they are sometimes referred to as vests. The term "vest" or "tactical vest" is used herein to describe all ballistic resistant garments that shield at least a portion of a wearer's torso, including those garments with and without sleeves, bottoms, etc.

Tactical vests often have many pockets, loops, and attachment points for holding armor plates or supplies. The more armor and supplies that are carried, the more a vest is weighted down. Some modern vests weigh approximately 30 pounds each. This can increase the physical demands on the wearer.

If a wearer in the field is injured or falls into water, it can be a matter or life and death to move the person to safety. It may be necessary to remove the wearer's tactical vest in order to move him or her. Likewise, it may be necessary to remove the wearer's tactical vest in order to administer first aid. Logically, being able to remove the wearer's tactical vest quickly and without further injuring a person can be very important.

Many currently-fielded tactical vests in the U.S. military provide an emergency release system. A requirement by the military is that the release system needs to allow for single hand, one-step operation. Cable-pull systems have been devised for such vests. To activate the cable-pull system, a person pulls and pulls feet of cable from the vest. As the cable is pulled, it unwinds itself from series of loops and holes that hold the parts of the vest together. After pulling the emergency release cable of a prior art vest, it is not uncommon to have pulled several feet of cable out of the vest. The cable can be a trip hazard if left on the floor.

After pulling the cable from a vest, the cable needs to be rethreaded through the loops and holes of the various panels of the vest to reassemble the tactical vest for further use. Currently fielded systems have been found to take about 9-30 minutes to reassemble a vest once its emergency release has been deployed.

The inventor has determined a need in the art for an alternate quick release mechanism for body armor or other tactical vests.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY

Generally, devices and assemblies pertaining to, and methods for using, tactical vests with a quick release buckle mechanisms are described. Some embodiments of the vests are in two parts: a front panel and a back panel. One panel, either the front of the back, has the shoulder straps and waistband straps sewed to it. The vests have a multi-point buckle on the opposite panel that accept belt tongues from shoulder straps and/or waistbands. To activate an emergency quick release, a lanyard is pulled. The lanyard is connected with a rotatable portion of the multi-point buckle. A small rotation of this part can quickly release the tongues from the buckle all at the same time.

A large flap can cover the rotatable buckle and incoming shoulder straps and waistband straps, protecting the buckle from accidental activation. Clips can attach from the waistband straps to their respective belt tongues so that a user can undo the waistband straps without activating the quick release for the shoulder straps and put on the vest. In some embodiments, a rotation of the rotatable portion in the opposite direction of the quick release can release only the waist straps without releasing the shoulder straps.

In some cases, a user can assemble an embodiment vest by threading the shoulder straps through holes in the panel with the multi-point buckle, buckling the shoulder straps and waistband straps to the multi-point buckle, and folding the flap over everything to protect it from inadvertent activation or from snags. While wearing the vest, pulling a lanyard rotates a release-cam on the buckle, releasing the buckles so that the vest falls to the floor.

Multi-point buckle mechanism aspects are described. Each buckle mechanism has an internal, spring-loaded, steel plate with pins projecting into multiple buckle recesses. A rotatable shaft with a cam pin that pulls or pushes the plate so as to release all attached belt tongues at once. A strap mount with a clip allows one to clip and unclip an attached strap without having to release all the straps using the buckle's release mechanism.

An embodiment of the present application relates to a tactical vest with a quick release buckle mechanism, including a first torso panel, shoulder straps coupled to the first panel, each shoulder strap having a belt tongue at an end, and waist straps coupled to the first panel, each waist strap having a belt tongue at an end. The vest includes a second torso panel, the second torso panel adapted to be worn on an opposite side of a body from the first panel, a multi-point buckle mechanism coupled to the second panel, the buckle mechanism configured to mate with the multiple belt tongues, thereby forming a wearable vest. A quick release on the buckle mechanism is adapted to release the belt tongues at substantially the same time, detaching the second panel from the first panel and allowing the vest to fall off a wearer.

The vest's waist straps can have releasable clips releasably attached to the respective belt tongues, thereby allowing a user to release the waist straps without activating the quick release. The multi-point buckle mechanism is optionally configured to release mated belt tongues upon rotating a portion of the buckle mechanism, and a lanyard can be coupled to the quick release and configured to activate the quick release when pulled.

Another embodiment relates to a method of preparing and quickly removing a tactical vest. The method includes providing a vest having a first torso panel with shoulder straps terminating at belt tongues and waist straps terminating at belt tongues, inserting the belt tongues into a multi-point buckle mechanism coupled to a second panel of the vest, donning the vest, and activating a quick release on the buckle mechanism to release the belt tongues at substantially the same time. This allows the shoulder straps to slide away, waist straps to loosen, and the vest to fall toward the Earth.

Another embodiment relates to a multi-point buckle mechanism, including a housing having multiple buckle recesses, a rotatable shaft coupled to the housing, the shaft having a first position and second position rotated from the first position, a plate having projections, the projections projecting into the buckle recesses when the rotatable shaft is in the first position and at least partially withdrawn from the buckle recesses when the rotatable shaft is in the second position, belt tongues configured to mate with the buckle recesses, and a strap mount having a clip, the clip configured to releasably mate to at least one of the belt tongues. The plate having projections is configured to release belt tongues in the recesses at substantially the same time by rotating the shaft.

A further understanding of the nature and the advantages of the embodiments disclosed and suggested herein may be realized by reference to the remaining portions of the specification and the attached drawings.

Figure 1:
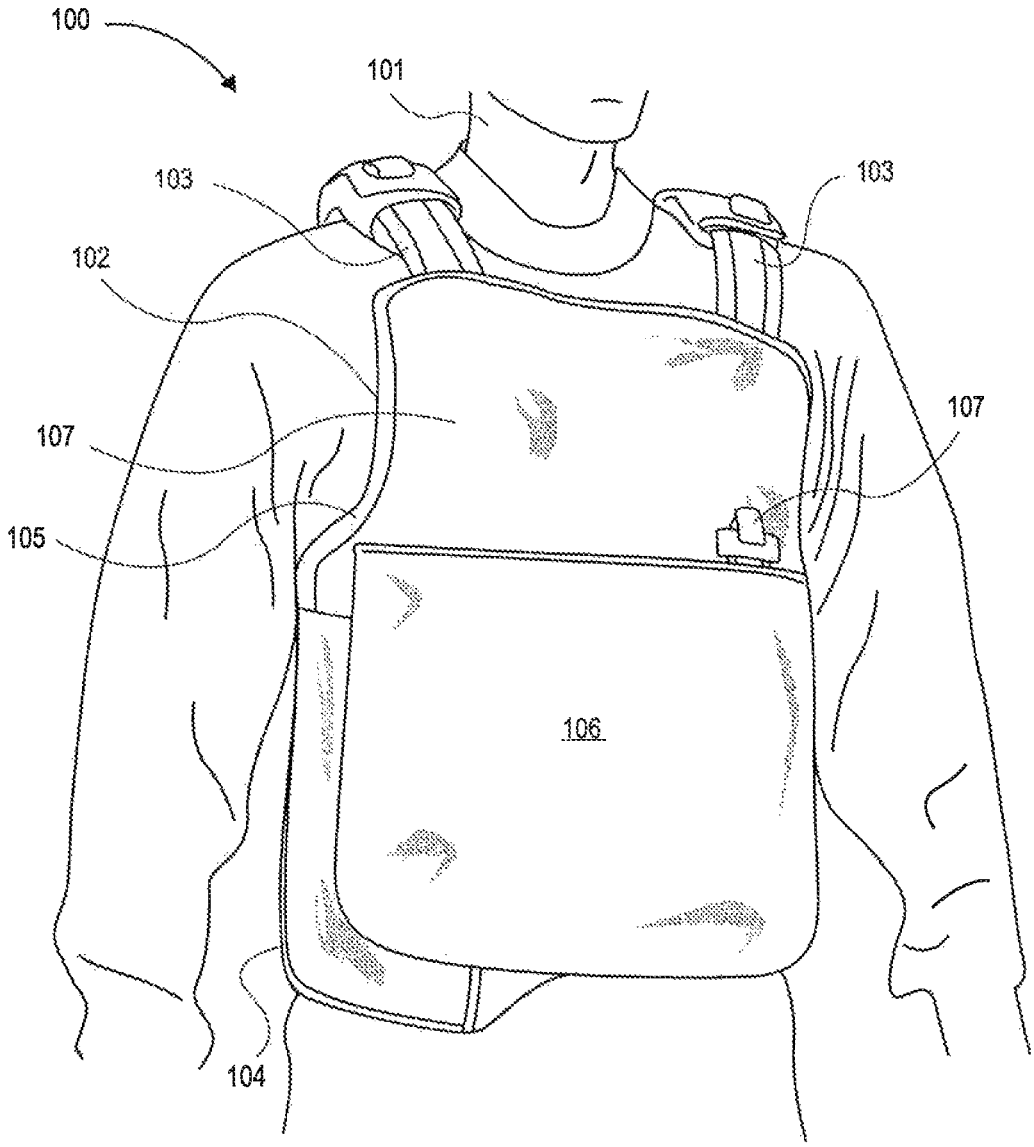
FIG. 1 illustrates a tactical vest worn by a user in accordance with an embodiment.

The figures will now be used to illustrate different embodiments in accordance with the invention. The figures are specific examples of embodiments and should not be interpreted as limiting embodiments, but rather exemplary forms and procedures.

DETAILED DESCRIPTION

Devices, assemblies, and methods are hereby described relating to tactical vests with quick-release buckle mechanisms. The vests have a front panel and a rear panel, one of which can have shoulder straps and waistband straps attached. The shoulder straps and waistband straps have seat belt-like tongues at their ends that fit into the buckle mechanism. In some embodiments, the buckle mechanism is activated by pulling a lanyard attached to a rotary mechanism on the buckle mechanism. This releases all the tongues from the buckle at the same time.

A flap can cover the buckle, tongues, and straps so that they do not catch on things and to prevent inadvertent activation of the buckle mechanism. Clips can attach nylon portions of the waistband strap to the tongues so that a user can unclip the waistband straps and put on or take off the vest without activating the quick-release buckle mechanism. In some embodiments, the buckle mechanism can be activated to release only the waist straps while retaining the shoulder straps.

Technical advantages of embodiments include a buckle quick release that can release instantaneously several bearing straps on a tactical vest all at once. Because all of the straps are released at once, the vest can fall cleanly to the ground. Emergency releases on prior art vests, which typically feature a cable that is pulled from various loops and holes that bind the parts of the vest together, do not release all of the part of the vest at once. Parts of the vest can still be attached to each other while other parts are released, causing the vest to peel away asymmetrically. The wearer can be caught off balance. Even if the cable is pulled very quickly, the slight delay in releasing sections of the vest can impart rotation as the sections are asymmetrically supported. With armor plates and heavy supplies in some sections, the rotating, descending sections can pull the wearer off balance or cause injury to feet and ankles. In a present embodiment, after pulling a quick release, a buckle-tongue mechanism can be relatively easy to thread back together to reassemble the vest. Large, easy to grasp metal tongues and wide straps can be threaded through large openings relatively easily as compared with a prior art method of threading thin cables through fabric loops and small holes.

Events happening at "substantially the same time" include events that occur simultaneously as well as events that occur within 1, 2, 5, or more seconds of one another and as is reasonable in the art for the events to occur.

According to one embodiment, a quick release mechanism is provided to allow a wearer to quickly remove the vest, e.g., in an emergency situation that requires vest removal. A single point, mechanical quick release system detaches the waist cummerbund and the shoulder straps simultaneously. The mechanical release mechanism includes a rotary release mechanism in one embodiment. Under normal operation, the waist attach points attach/detach with mechanical buckles. In an emergency situation, the wearer pulls a lanyard, which disengages the shoulder straps and the waist attachments simultaneously.

FIG. 1 illustrates a tactical vest worn by a user in accordance with an embodiment. In wearable system 100, user 101 dons tactical vest 102. Shoulder straps 103 extend from a back panel (not shown in the figure) of the vest over the user's left and right shoulders to front panel 105. Likewise, cummerbund waist straps 104 extend from the back panel along the user's waist to front panel 105. Shoulder straps 103 and waist straps 104 have portions that extend underneath flap 106.

Figure 2:
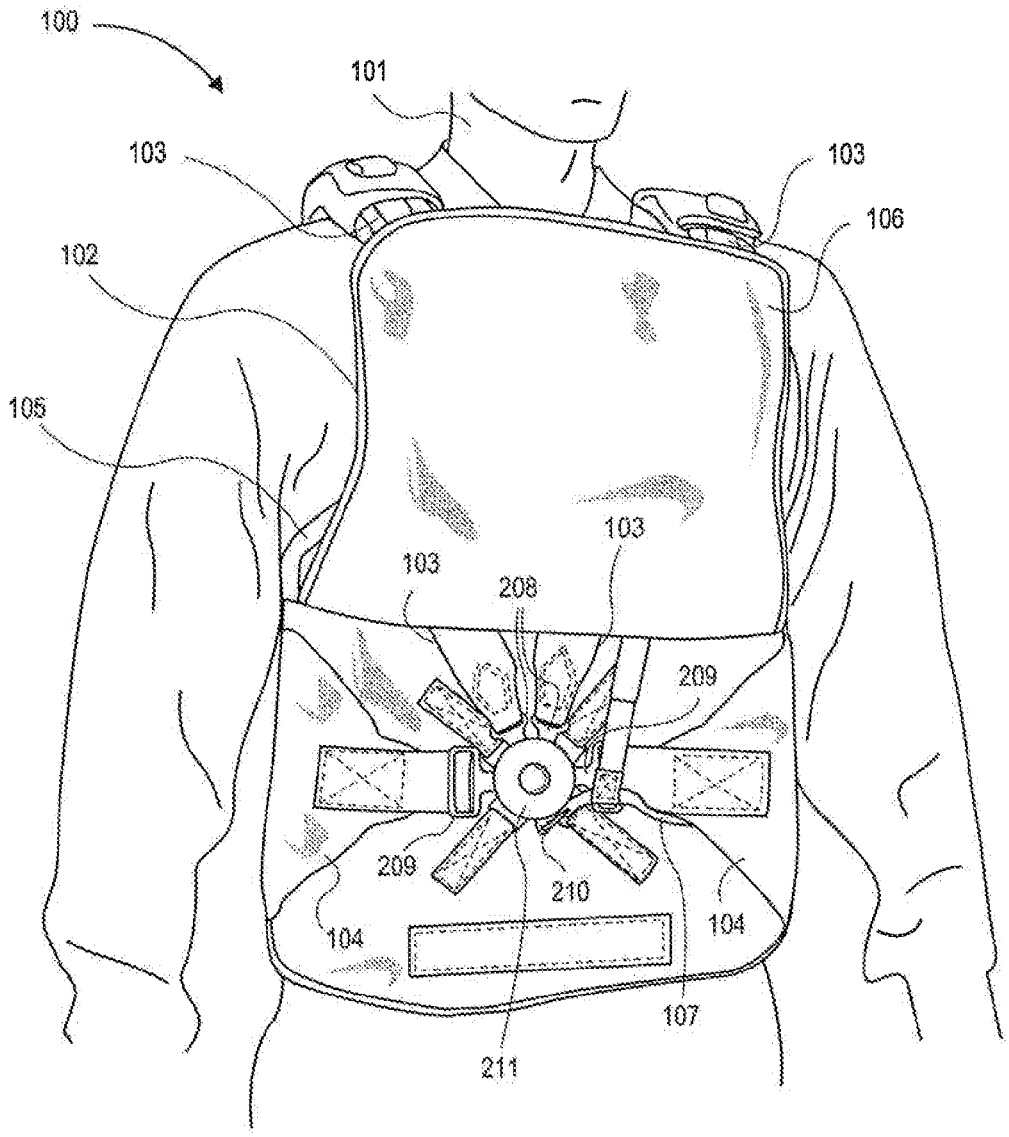
FIG. 2 illustrates the tactical vest of FIG. 1 with its flap upturned and buckle exposed.

FIG. 2 illustrates the tactical vest of FIG. 1 with its flap upturned. Right and left shoulder straps 103 terminate at shoulder strap belt tongues 208. Extra fabric loops (not shown in the figure) can extend beyond the belt tongues to help the user in cinching the vest tightly. Right and left cummerbund waist straps 104 terminate at waist strap belt tongues 209. Extra fabric looks can be placed on the cummerbund waist straps as well. Belt tongues 208 and 209 are inserted in multi-point buckle mechanism 211 in the center of front panel 105.

Buckle mechanism 211 features a rotational release mechanism that can disengage all four belt tongues simultaneously. The four-point buckle is activated to release the tongues by pulling release tang 210 at the bottom of the mechanism to the right (i.e., the user's left). In some embodiments, pulling release tang 210 to the left (i.e., the user's right) can release only the waist straps while retaining the shoulder straps. Placing the tang at the bottom of the buckle keeps the lanyard away from inadvertently getting knocked or hung up by the various belt tongues at the 2, 10, 9, and 3 o'clock positions on the buckle mechanism. When flap 106 is down, pulling the tang can be swiftly accomplished simply by pulling lanyard 107 at its end (occluded in the figure).

Lanyard 107, a cable, is routed from the bottom of buckle mechanism 211 over to the user's left side, where it goes through a metal loop. The metal loop can be covered by the cummerbund, or it can be on a longer fabric loop as shown in the exemplary embodiment. The metal loop acts as a pulley, changing the direction of the tension of lanyard 107. Lanyard 107 proceeds up front panel 105 of vest 102, underneath its flap. Lanyard terminates at a small, half-inch wide strap. The strap can be secured by folding it over in a utility loop, as shown in FIG. 1. The strap can be additionally secured with hook and loop fasteners, such as Velcro® fasteners.

In an alternate cable release system, the lanyard continues from the front panel back through a hollow, padded section of the user's left shoulder strap to the back panel of the vest. The front panel and the back panel are on opposite sides of the user's body. The lanyard then proceeds through a hollow section of nylon webbing raceway underneath a flap of the back panel of the vest behind the user's neck. After crossing behind the user's neck, the lanyard proceeds from the back panel forward through a padded, hollow section of the user's right shoulder strap to the front panel. Slack of the lanyard cable can be stored in any one of the sections in order to prevent a slight, inadvertent pull from activating the buckle mechanism. The end of the lanyard exits the front of the user's right shoulder strap. The end of the lanyard can be secured into any one of many loops that can be sewn on the front panel of the vest.

In the alternate cable release system, the system includes nylon webbing raceways for the cable. Main attach points for the cable release vest are at the ends of the front shoulder straps and the back lower center of the vest, where the back two sides of the cummerbund attach. This can allow for the vest to be worn as snugly as a non quick release vest, but enables the wearer to escape the vest in an emergency situation. Additionally at the attach points, a steel or other durable material ring system is used. The steel rings slip over the nylon webbing raceways and apply pressure against the cable at each of the attach points. This mitigates or prevents slippage or cable wear.

Figure 3:
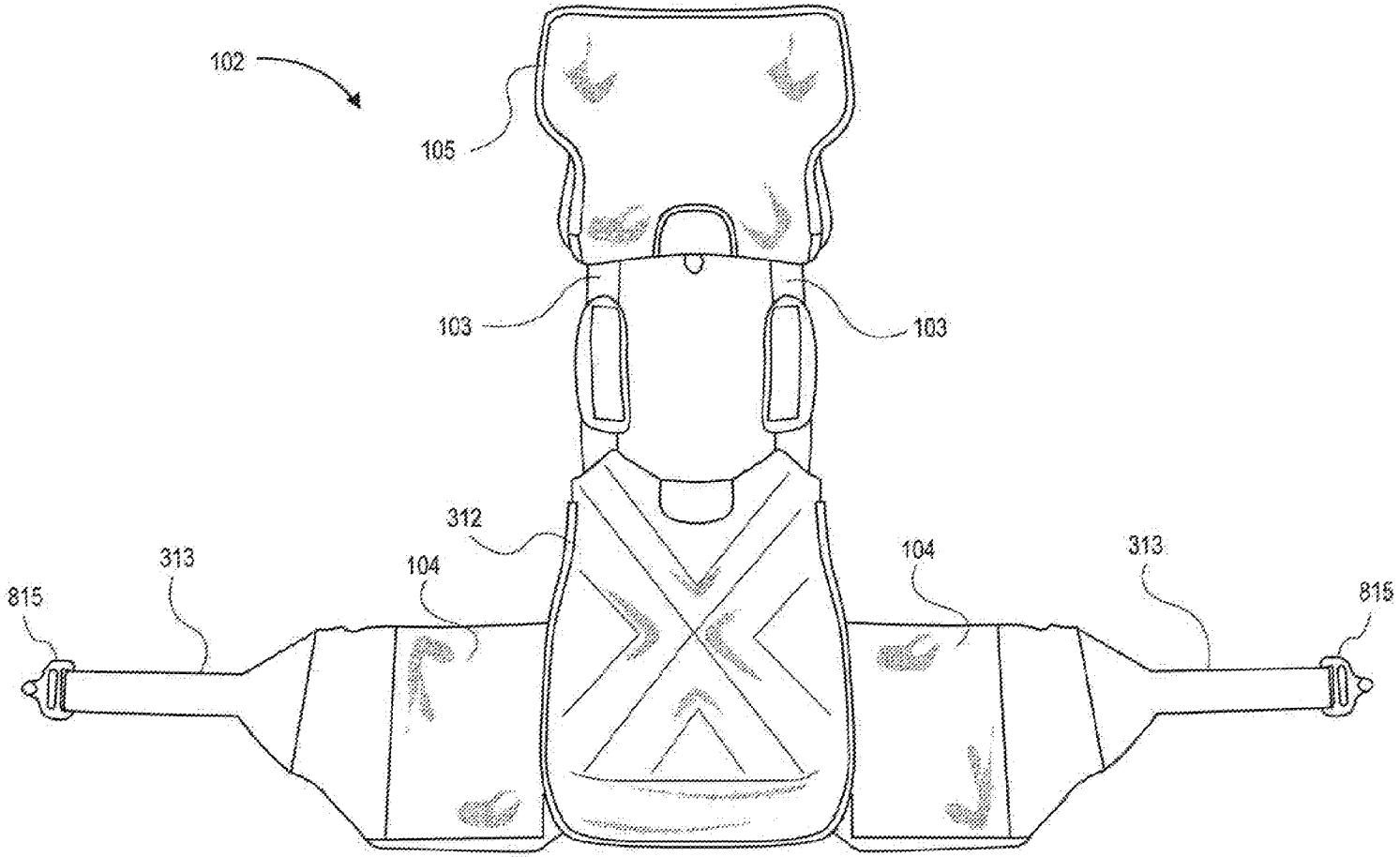
FIG. 3 illustrates the interior of a tactical vest in accordance with an embodiment.

FIG. 3 illustrates the inside, interior of a tactical vest in accordance with an embodiment. Vest 102 is laid out on a flat surface for illustration purposes. Shown are the sides that are proximate to the user's body when worn. Front panel 105 connects through shoulder straps 103 to back panel 312. Cummerbund waist straps 104 form an upside-down "T" with the rest of the vest. Nylon webbing 313 allow for further adjustment on the body of a user and can be tightened through the loops of tongues 815.

Figure 4:
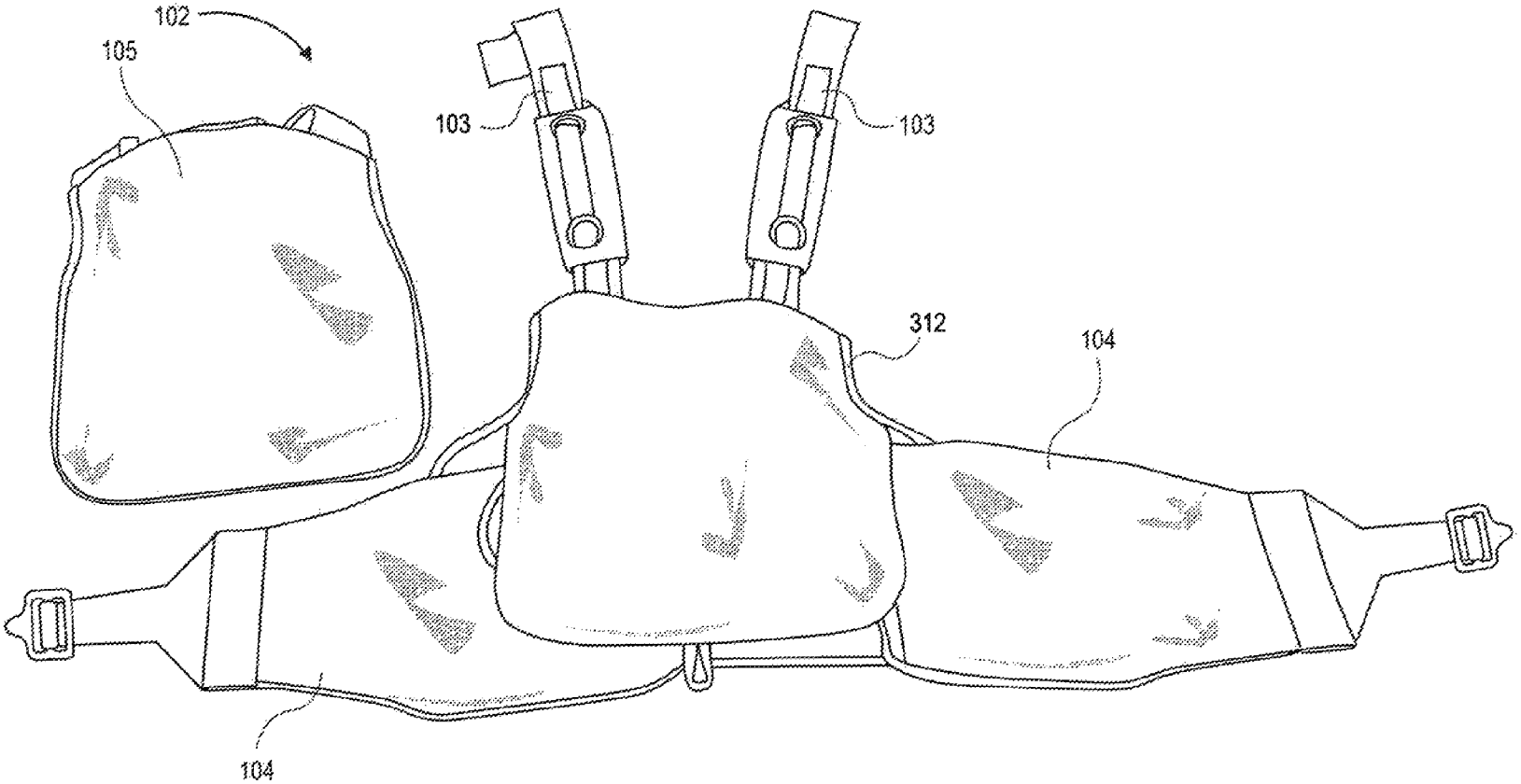
FIG. 4 illustrates the outside of a tactical vest, with the front panel detached, in accordance with an embodiment.

FIG. 4 illustrates the outside, exterior of a tactical vest, with a panel detached, in accordance with an embodiment. Vest 102 include panel 312 with cummerbund waist straps 104 integrated on its left and right sides. Shoulder straps 103 are sewn to panel 312. Panel 105 is completely detached from panel 312 in the figure.

A wearer puts on and removes the vest by slipping it over his or her head. To secure the vest, the wearer firmly attaches the ambidextrous cummerbund system. Once the vest is attached, the wearer closes the protective flap, which attaches with hook and loop fasteners.

Figure 5:
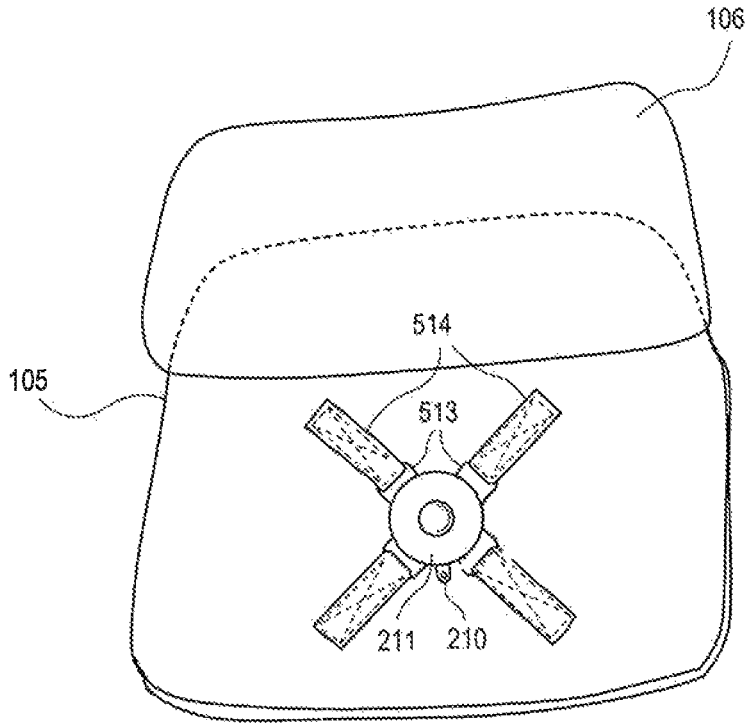
FIG. 5 illustrates a buckle mechanism on a front panel of a tactical vest in accordance with an embodiment.

FIG. 5 illustrates a buckle mechanism on a front panel of a tactical vest in accordance with an embodiment. Without the incoming shoulder straps, waist straps, and their belt tongues, buckle mechanism may be easier viewed in the figure. Underneath flap 106 of detached front panel 105, buckle mechanism 211 lies in the center. It is secured to the panel by mounts 513 and sewn straps 514. Release tang 210 is at the bottom of the buckle mechanism.

Figure 6:
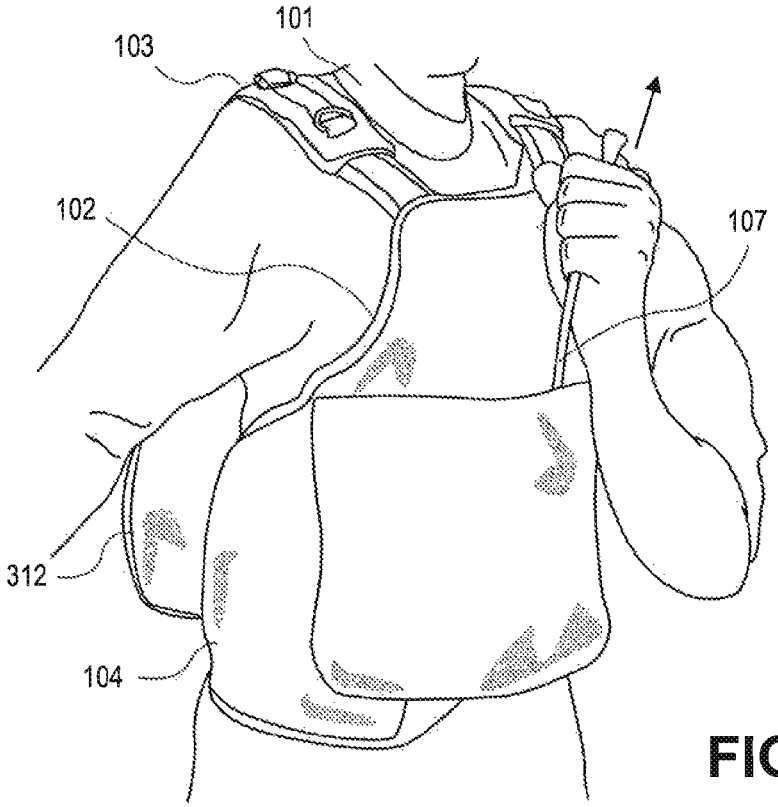
FIG. 6 illustrates a wearer pulling a quick release lanyard in accordance with an embodiment.

FIG. 6 illustrates a wearer pulling a quick release lanyard in accordance with an embodiment. Wearer 101 dons vest 102. Vest 102 is weighted down with Small Arms Protective Insert (SAPI) ceramic armor plates. Shoulder straps 103 and waist straps 104 firmly secure front panel 102 and back panel 312 to the wearer. The wearer then pulls lanyard 107 to activate the quick release mechanism.

Lanyard 107 pulls a release tang on the rotary, multi-point buckle mechanism to release all four belt tongues, corresponding to the left and right shoulder straps and left and right waist straps, all at once. Because the four bearing tongues release all at once, there is minimal torque caused by partially supported panels or other portions. The forces that support the weight of the SAPI plates just disappear. Gravity then causes the various parts of the vest to fall downward toward the Earth.

Figure 7:
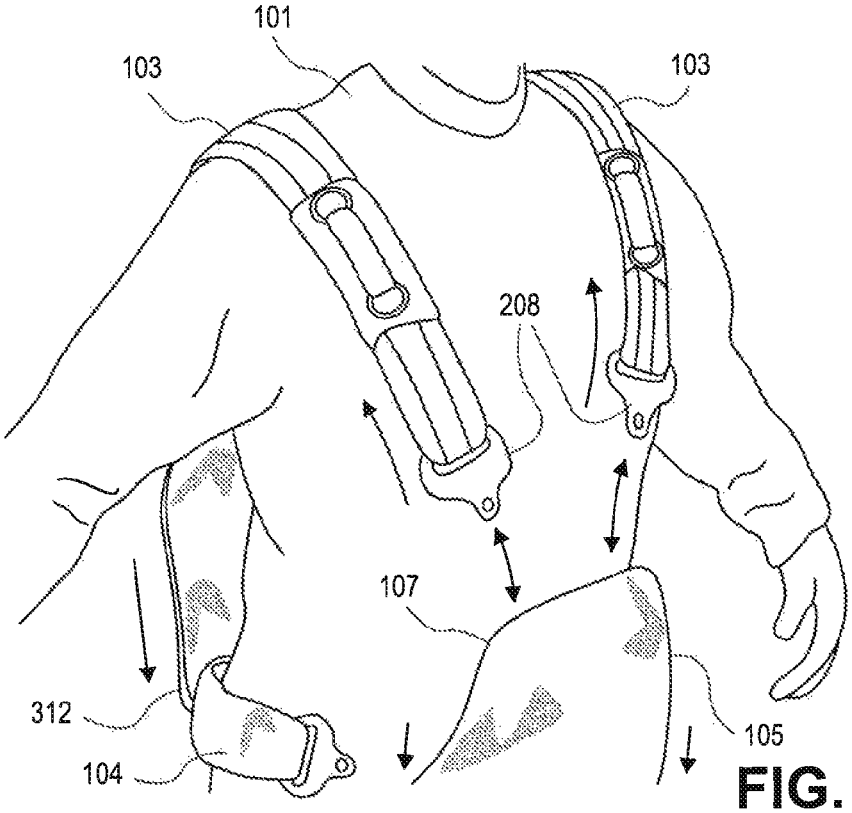
FIG. 7 illustrates the vest of FIG. 6 falling off a wearer.

FIG. 7 illustrates the vest of FIG. 6 falling off a wearer. Front panel 105, no longer supported by upward forces from the shoulder straps, heads downward. Back panel 312, also no longer supported by upward forces from the shoulder straps, heads downward. Because both the left and right shoulder straps release simultaneously, the panels head downward cleanly with minimal-to-no yaw or roll rotations.

Shoulder straps 103, which are still attached to back panel 312, whiz upward around the shoulders of the wearer. The accelerating shoulder straps stay close to the user and do not fly out because the rounded path over the shoulders and closest to the torso is generally the path of least energy for the flexible straps to follow. The natural outward slant of a wearer's trapezius can cause the straps to move distally from the wearer's neck and away from his or her face. By the time the ends of the shoulder straps, with fast moving metal buckles 208, pass the wearer's shoulders, shoulder straps 103 can move laterally outward over or past the wearer's deltoids.

Waist straps 104 unbuckle at the same time as the shoulder straps and simultaneously with each other. This minimizes asymmetric snagging around the waist and minimizes yaw or roll rotation of the downwardly heading panels. This also minimizes a tendency of the top of the panels to start tilting away from the user and negatively imparting a pitch rotation to the panels as they head down.

The weight of the SAPI panels and other supplies strapped to the vest assists in overcoming static and kinetic friction between the vest and the user and between the straps and the rest of the vest. The more weight on the vest, the more force to overcome the friction, and the less asymmetric rotation caused by the friction. In some embodiments, the more weight, the more cleanly the vest will slide off a wearer. With a real-world tactical vest loaded down with dozens of pounds of SAPI plates and supplies, the vest has been found to drop off a user very cleanly.

Figure 8:
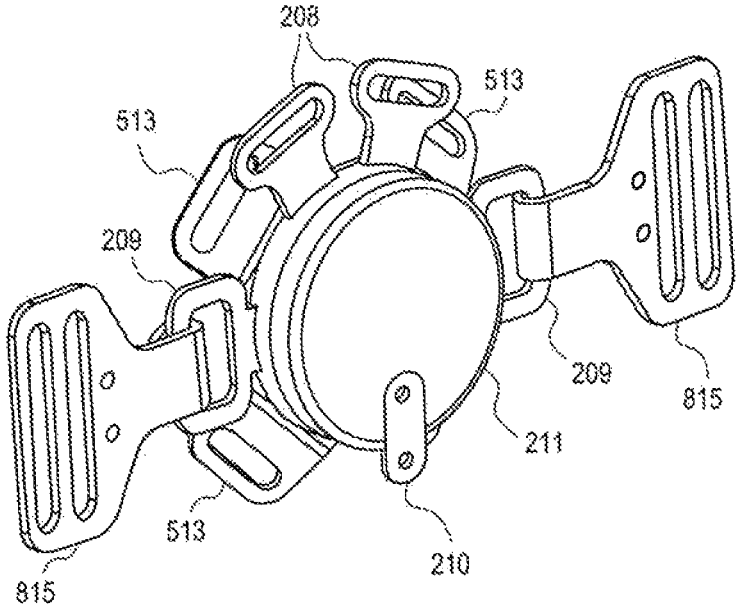
FIG. 8 is an orthographic illustration of a front of a multi-point buckle mechanism in accordance with an embodiment.
Figure 9:
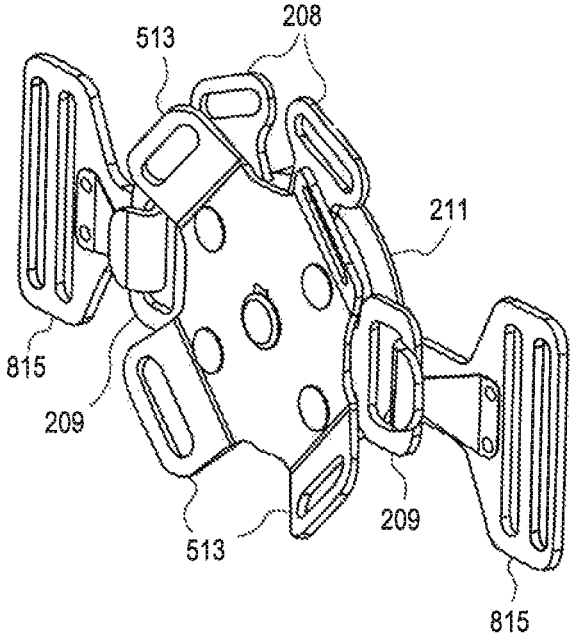
FIG. 9 is an orthographic illustration of a rear of the multi-point buckle mechanism of FIG. 8.
Figure 10:
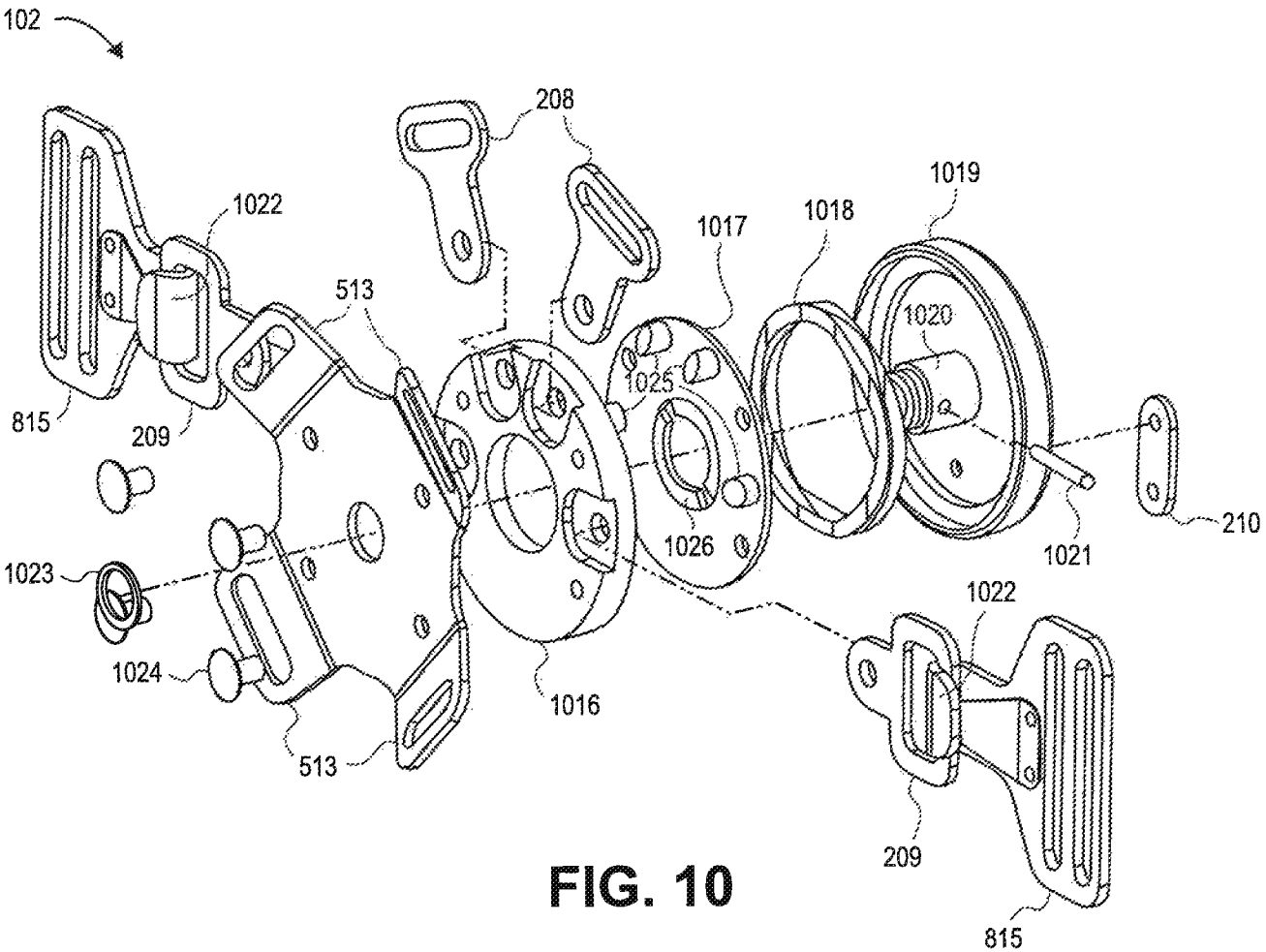
FIG. 10 is an exploded view from the rear of the multi-point buckle mechanism of FIG. 8.

FIGS. 8-10 are an orthographic illustrations of a multi-point buckle mechanism in accordance with an embodiment.

Multi-point, rotationally activated buckle mechanism 211 includes mounts 513 and release tang 210. Mounts 513 are slightly canted from the back plane of the buckle so that the buckle is more securely fastened to the front panel using sewn straps 514 (see FIG. 5). Shoulder strap belt tongues 208 mate into recesses in the buckle housing at approximately the 2 and 10 o'clock positions. Waist strap belt tongues 209 mate into recesses in the buckle housing at approximately the 3 and 9 o'clock positions.

Nylon webbing of waist straps can fasten to releasable clips 815 instead of directly to waist strap belt tongues 209. Releasable clips 815 in turn connect with waist strap belt tongues 209. A user can unclip releasable clips 815 in order to release the waist straps without activating the emergency release mechanism and ejecting shoulder strap belt tongues 208. This allows a user to more easily put on an attached vest.

According to one embodiment, the shoulder straps extend down into the front of a centrally located rotary mechanism. The shoulder straps terminate into steel tangs/tongues, which mate into the buckle, e.g., at the top of the buckle. The shoulder straps connect at the various positions, e.g., 2 o'clock, and 10 o'clock positions, on the buckle. In the embodiment, the waist attach points terminate in the front, rather than in the back of the vest. The waist attach points may connect at 3 o'clock, and 9 o'clock portion of the buckle, as shown. Under normal operation, the waist attach points clip onto female tangs/buckles, which are permanently installed into the buckle mechanism. The wearer clips on and clips off the waist attach points under normal operation. In an emergency situation, the wearer pulls the quick release lanyard, which deploys all four attach points, and the vest immediately drops to the ground.

In some embodiments, the waist strap tongues can be released from the buckle mechanism without releasing the shoulder strap tongues. This can be accomplished by rotating the activation mechanism in the opposite direction from the four-point quick release.

Present embodiments of the cable release system offer an improvement over existing cable systems. It has been shown in some embodiments that the mechanical release mechanism takes mere seconds to reassemble. Threading wide, belt buckle-like straps through elongated holes can be easier in the field than threading thin shoelace-like cable through tiny eyelets.

FIG. 10 illustrates internal portions of buckle mechanism 102. Mounts 513 are part of the same metal plate; the plate abuts against buckle body 1016. Belt tongues 209 and 208 can be inserted by a user into recesses of buckle body 1016. Pin cam plate 1017, with integrated pin protrusions 1025, is biased against buckle body 1016 by wavy spring plate 1018. Spring plate 1018 can be welded or otherwise attached to pin cam plate 1017 in some embodiments. Additionally, in certain aspects, a detent keeps the rotary buckle in the "default" neutral position. Alternatively, coil springs and other mechanical spring mechanisms can be used. Base plate 1019 forms a housing over the spring plate 1018 and pin cam plate 1017.

Rotatable shaft 1020 extends from base plate 1019 through spring plate 1018, pin cam plate 1017, buckle body 1016 to the mount plate, where it is held in place while being allowed to rotate by snap ring 1023. Mount screws 1024 fasten portions of the assembly together.

Cam pin 1021 protrudes from shaft 1020. When release tang 210 is pulled or pushed tangentially to the housing, it rotates the housing and rotatable shaft 1020. Cam pin 1021 bears directly against tapered ramp area 1026 and pulls or pushes pin cam plate 1017 against spring plate 1018. In alternate embodiments, a screw/threaded mechanism can be used. The movement of pin cam plate 1017 withdraws protrusions 1025 from recesses in buckle body 1016, thereby releasing all mated tongues simultaneously.

Once the release has been activated, the spring returns the buckle to the default "neutral" position so that it is ready for reengagement of the four attach points.

Figure 11:
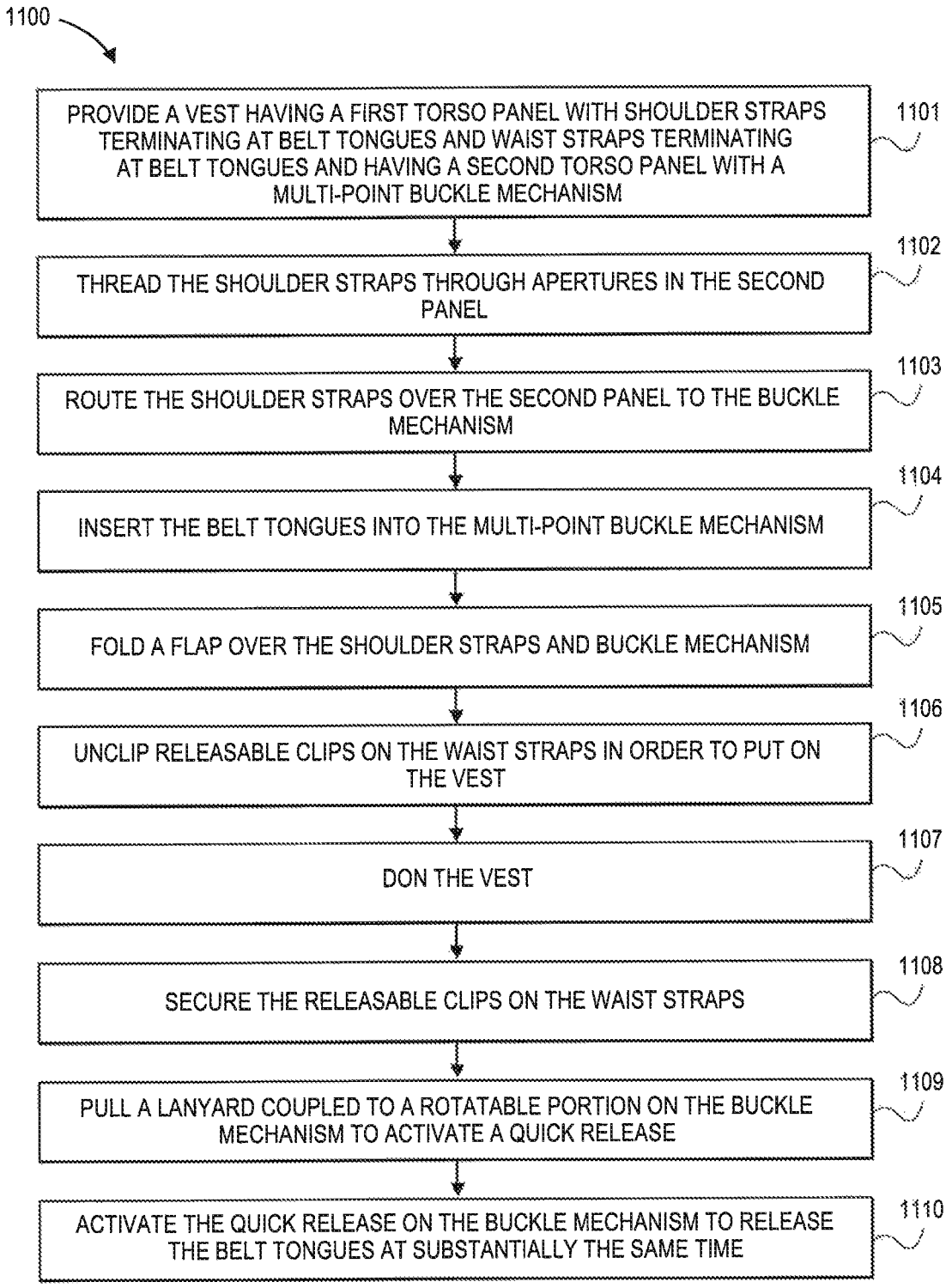
FIG. 11 is a flowchart of a process in accordance with an embodiment.

FIG. 11 is a flowchart illustrating a process in accordance with an embodiment. Process 1100 includes operations that are optional. In operation 1101, a vest is provided having a first torso panel with shoulder straps terminating at belt tongues and waist straps terminating at belt tongues. The vest also has a second torso panel with a multi-point buckle mechanism. The first panel can be a back panel and the second panel a front panel, or vice versa. In operation 1102, the shoulder straps are threaded through apertures in the second panel. In operation 1103, the shoulder straps are routed over the second panel to the buckle mechanism. In operation 1104, the belt tongues are inserted into the multi-point buckle mechanism. In operation 1105, a flap is folded over the shoulder straps and buckle mechanism. In operation 1106, releasable clips on the waist straps are unclipped in order to put on the vest. In operation 1107, the vest is donned. In operation 1108, the releasable clips on the waist straps are secured to the waist strap belt tongues. In operation 1109, a lanyard coupled to a rotatable portion on the buckle mechanism is pulled to activate a quick release. In operation 1110, the quick release on the buckle is activated to release the belt tongues at substantially the same time.

While the invention has been described by way of example and in terms of the specific embodiments, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

Titles and subtitles used in the text, if any, are intended only as aids to guide the reader and as an organization tool. These titles are not intended to specifically describe the applicable discussion or imply any limitation of that discussion.

What is claimed is:

1. A tactical vest with a quick release buckle mechanism, comprising:

a first torso panel;

shoulder straps coupled to the first panel, each shoulder strap having a belt tongue at an end;

waist straps coupled to the first panel, each waist strap having a belt tongue at an end;

a second torso panel, the second torso panel adapted to be worn on an opposite side of a body from the first panel;

a multi-point buckle mechanism coupled to the second panel, the buckle mechanism configured to mate with the multiple belt tongues, thereby forming a wearable vest;

wherein a quick release on the buckle mechanism is adapted to release the belt tongues at substantially the same time, detaching the second panel from the first panel and allowing the vest to fall off a wearer.

2. The vest of claim 1 wherein the waist straps have releasable clips releasably attached to the respective belt tongues, thereby allowing a user to release the waist straps without activating the quick release.

3. The vest of claim 1 wherein an alternate release on the buckle mechanism is adapted to release the waist strap belt tongues without releasing the shoulder strap belt tongues.

4. The vest of claim 1 wherein the multi-point buckle mechanism is configured to release mated belt tongues upon rotating a portion of the buckle mechanism.

5. The vest of claim 4 further comprising:

a lanyard coupled to the quick release and configured to activate the quick release when pulled.

6. The vest of claim 5 wherein the lanyard is attached to a bottom of the buckle mechanism and configured to pull a quick release left or right.

7. The vest of claim 1 wherein the second torso panel comprises a flap configured to cover the buckle mechanism and belt tongues when mated.

8. The vest of claim 1 wherein the first torso panel is a back panel and the second torso panel is a front panel.

9. The vest of claim 1 wherein the panels have interior compartments configured for supporting armor plates, a weight of the armor plates assisting the vest to fall off the wearer after the quick release is activated.

10. A method of preparing and quickly removing a tactical vest, the method comprising:

providing a vest having a first torso panel with shoulder straps terminating at belt tongues and waist straps terminating at belt tongues, and having a second torso panel with a multi-point buckle mechanism;

inserting the belt tongues into the multi-point buckle mechanism;

donning the vest; and activating a quick release on the buckle mechanism to release the belt tongues at substantially the same time, thereby allowing the shoulder straps to slide away, waist straps to loosen, and the vest to fall toward the Earth.

11. The method of claim 10 further comprising:

unclipping releasable clips on the waist straps in order to put on the vest; and then securing the releasable clips on the waist straps.

12. The method of claim 10 further comprising:

pulling a lanyard coupled to a rotatable portion on the buckle mechanism to activate the quick release.

13. The method of claim 10 wherein the second panel has a flap configured to cover a portion of the shoulder straps and the buckle mechanism, the method further comprising:

threading the shoulder straps through apertures in the second panel;

routing the shoulder straps over the second panel to the buckle mechanism; and folding the flap over the shoulder straps and buckle mechanism.

14. A multi-point buckle mechanism, comprising:

a housing having multiple buckle recesses;

a rotatable shaft coupled to the housing, the shaft having a first position and second position rotated from the first position;

a plate having projections, the projections projecting into the buckle recesses when the rotatable shaft is in the first position and at least partially withdrawn from the buckle recesses when the rotatable shaft is in the second position;

belt tongues configured to mate with the buckle recesses; and a strap mount having a clip, the clip configured to releasably mate to at least one of the belt tongues, wherein the plate having projections is configured to release belt tongues in the recesses at substantially the same time by rotating the shaft.

15. The buckle mechanism of claim 14 further comprising:

a spring biasing the projections into the buckle recesses;

a cam pin coupled to the rotatable shaft, the cam pin configured to pull or push the plate against the bias and withdraw the projections from the buckle recesses when the shaft is rotated.

16. The buckle mechanism of claim 15 wherein the cam pin is configured to slide directly against the plate when the shaft is rotated.

17. The buckle mechanism of claim 14 wherein the plate having projections is configured to release a subset of belt tongues in the recesses by rotating the shaft.

18. The buckle mechanism of claim 14 further comprising:

a lanyard coupled to the rotatable shaft and configured to rotate the shaft when pulled.

19. The buckle mechanism of claim 14 wherein the belt tongues have apertures through which the clip is configured to releasably mate.

20. The buckle mechanism of claim 14 wherein the rotatable shaft, plate, and belt tongues comprise steel.

* * * * *